US005676253A

United States Patent [19]

Hsu

[11] Patent Number: 5,676,253

[45] Date of Patent: Oct. 14, 1997

[54] COMBINATION-TYPE TOOL BOX

[76] Inventor: Yi-Kung Hsu, 53, Lane Pu Wei, Lu Kang Town, Changhua, Taiwan

[21] Appl. No.: 678,646

[22] Filed: Jul. 11, 1996

[51] Int. Cl.[6] ..... B65D 25/04

[52] U.S. Cl. ..... 206/748; 206/372; 220/520

[58] Field of Search ..... 206/315.11, 372, 206/373, 585, 748, 822; 220/4.26, 4.27, 520

[56] References Cited

U.S. PATENT DOCUMENTS

| | | | |
|---|---|---|---|
| 3,058,579 | 10/1962 | Morin et al. | 220/520 |
| 4,320,846 | 3/1982 | Meyering et al. | 220/520 |
| 4,951,812 | 8/1990 | Chen | 206/748 |
| 4,998,616 | 3/1991 | Hillinger | 206/748 |

FOREIGN PATENT DOCUMENTS

| | | | |
|---|---|---|---|
| 2244259 | 11/1991 | United Kingdom | 206/372 |

*Primary Examiner*—Jimmy G. Foster

*Attorney, Agent, or Firm*—Beveridge, DeGrandi, Weilacher & Young LLP

[57] ABSTRACT

A combination-type tool box comprises a polygonal main body and a plurality of receiving boxes fastened pivotally with the main body such that the receiving boxes can be rolled in series to rest against the longitudinal sides of the main body. The main body is provided therein with a receiving space for keeping tools having a relatively larger dimension. The receiving boxes are provided therein respectively with a plurality of tool slots for keeping tools of various dimensions as well as a variety of component parts.

8 Claims, 5 Drawing Sheets

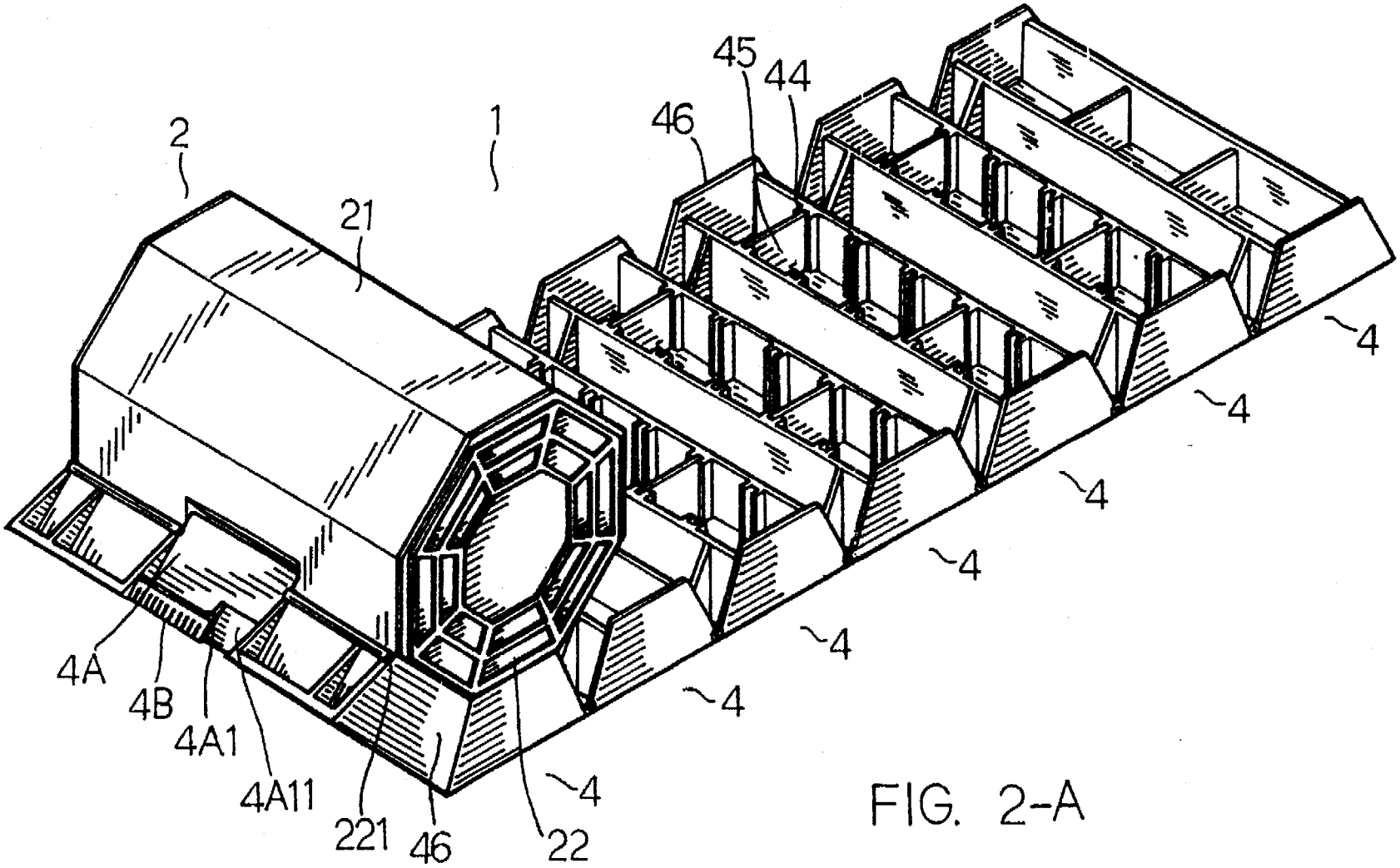
FIG. 2-A

COMBINATION-TYPE TOOL BOX

FIELD OF THE INVENTION

The present invention relates generally to a tool box, and more particularly to a combination-type tool box.

BACKGROUND OF THE INVENTION

The conventional tool box is generally provided therein with a plurality of slots of various dimensions for safekeeping of the hand tools; nevertheless it is limited in design in that it can not accommodate a hand tool having an extra large size.

SUMMARY OF THE INVENTION

The primary objective of the present invention is therefore to provide a combination-type tool box, which comprises a polygonal main body provided with a receiving space and a cover fastener thereto. The main body is fastened pivotally with one of a plurality of receiving boxes corresponding in number to the sides of the polygonal main body. The receiving boxes are fastened pivotally by means of a plurality of male hinges and female hinges such that the receiving boxes can be rolled as to rest against the periphery of the polygonal main body. The polygonal main body is intended for keeping the hand tools having a greater width while the receiving boxes are used for keeping the hand tools of various dimensions as well as a variety of component parts.

The foregoing objective, features, functions, and advantages of the present invention will be more readily understood upon a thoughtful deliberation of the following detailed description of a preferred embodiment of the present invention in conjunction with the accompanying drawings.

BRIEF DESCRIPTION OF THE DRAWINGS

FIG. 2A shows another schematic view of the unfolded tool box of the preferred embodiment of the present invention.

DETAILED DESCRIPTION OF THE EMBODIMENT

As shown m all drawings provided herewith, a combination-type tool box 1 embodied in the present invention is composed of the component parts which are described explicitly hereinafter.

Figure 5:
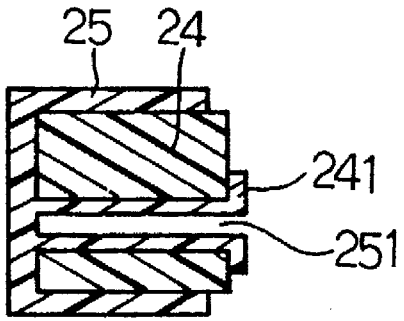
FIG. 5 shows a sectional view of the fastening switch of the main body of the preferred embodiment of the present invention.

A polygonal main body 2 is provided therein with a tool receiving space surrounded by a plurality of longitudinal sides 21 and two end sides 22. Each of two end sides 22 is provided along the edge thereof with a recessed lip 221. The main body 2 is further provided with an opening 23 and a side 211 which is provided with a female hinge 2111, as shown is FIGS. 3, 4 and 5. Located at another end of the opening 23 is a side 212 which is provided at the midsegment thereof with a recessed portion 2121 having a locating projection 24 which is provided horizontally with a sliding hole 241 and is further provided in one side thereof with a depression 242. The side 212 is provided with a female hinge 2122 and a fastening block 25 which is provided integrally with two legs 251 having an inverted hook and engageable with the sliding hole 241 of the locating projection 24.

Figure 2:
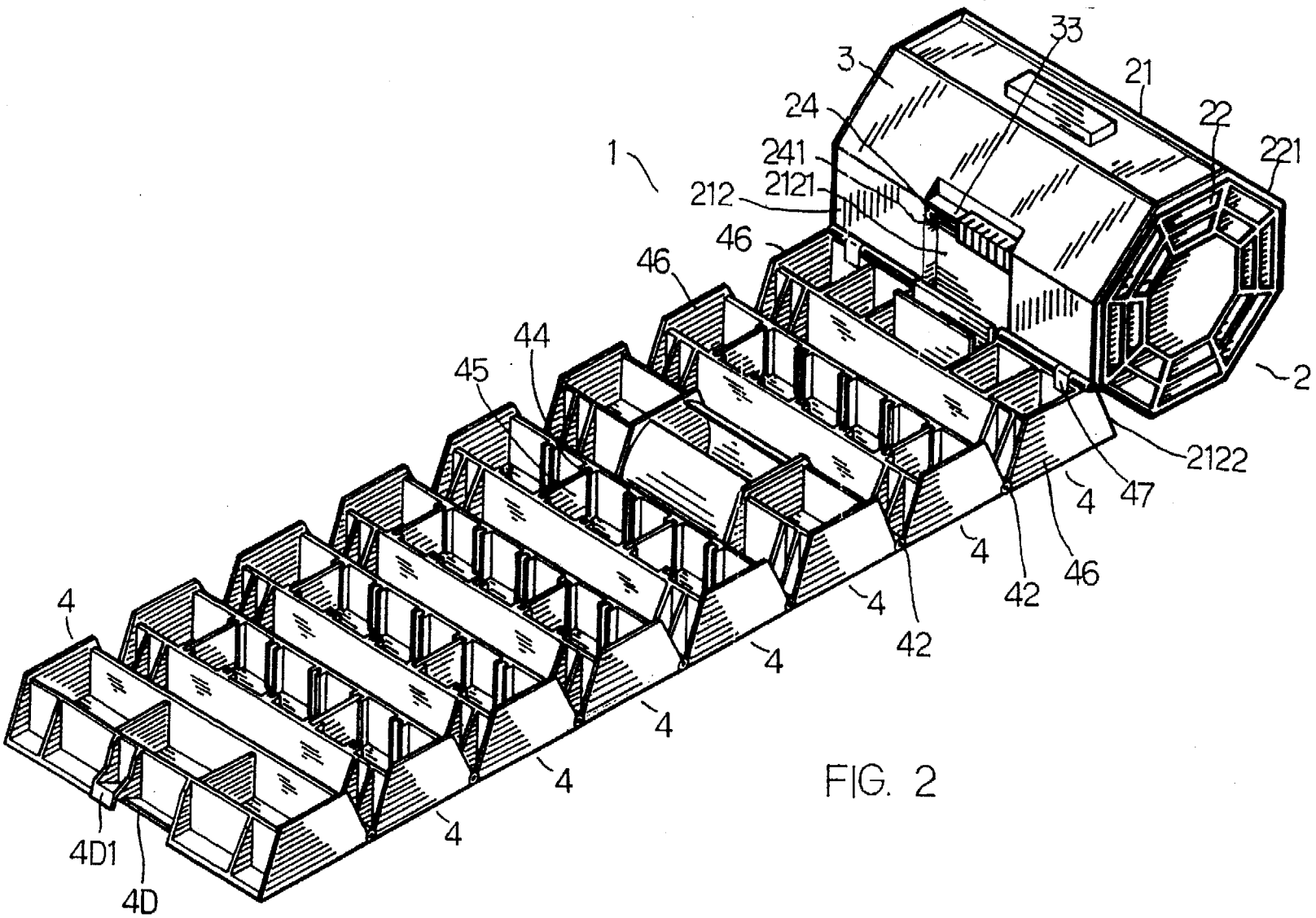
FIG. 2 shows a schematic view of an unfolded tool box of the preferred embodiment of the present invention.
Figure 3:
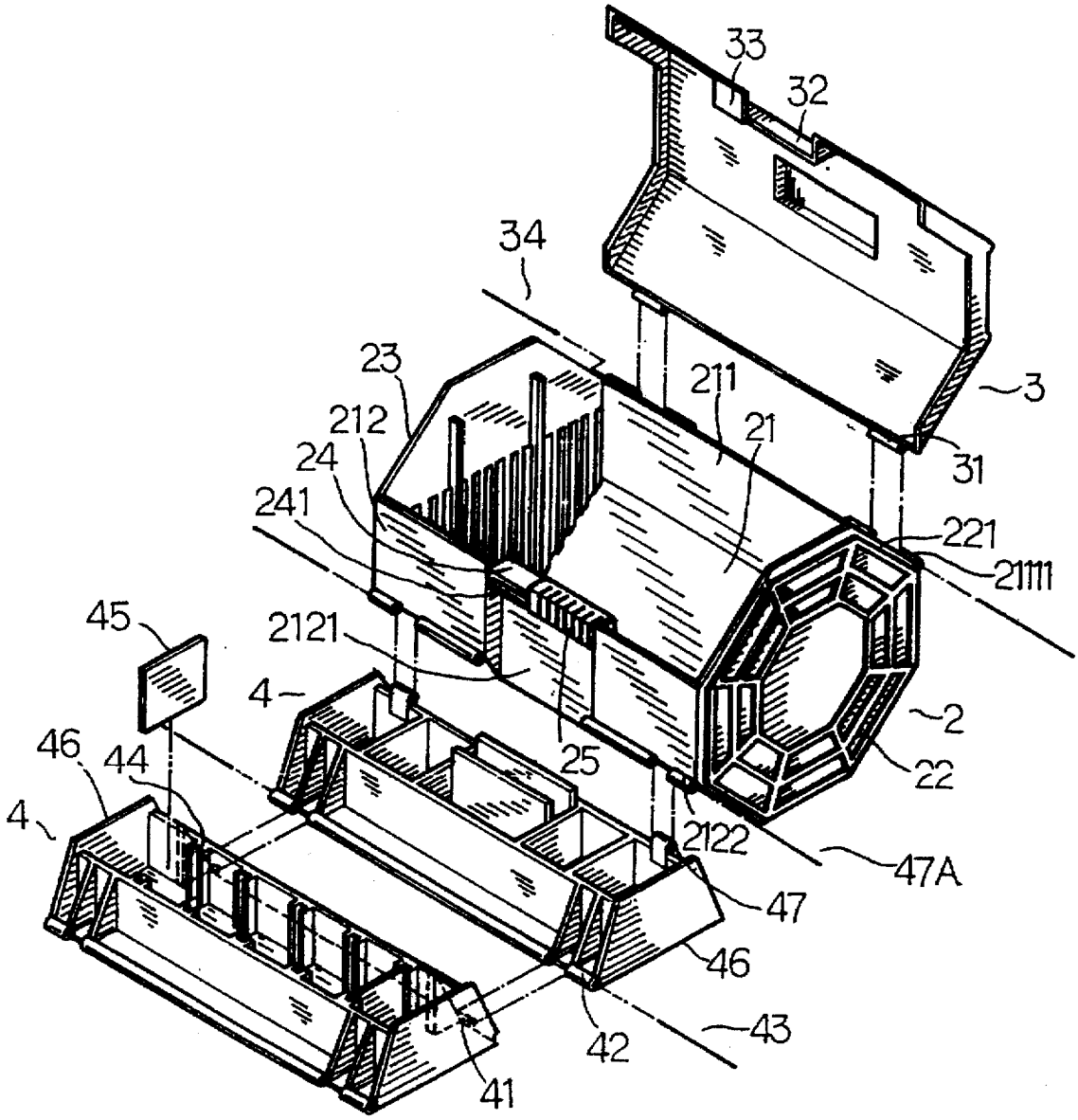
FIG. 3 shows a partial exploded view of the preferred embodiment of the present invention.
Figure 4:
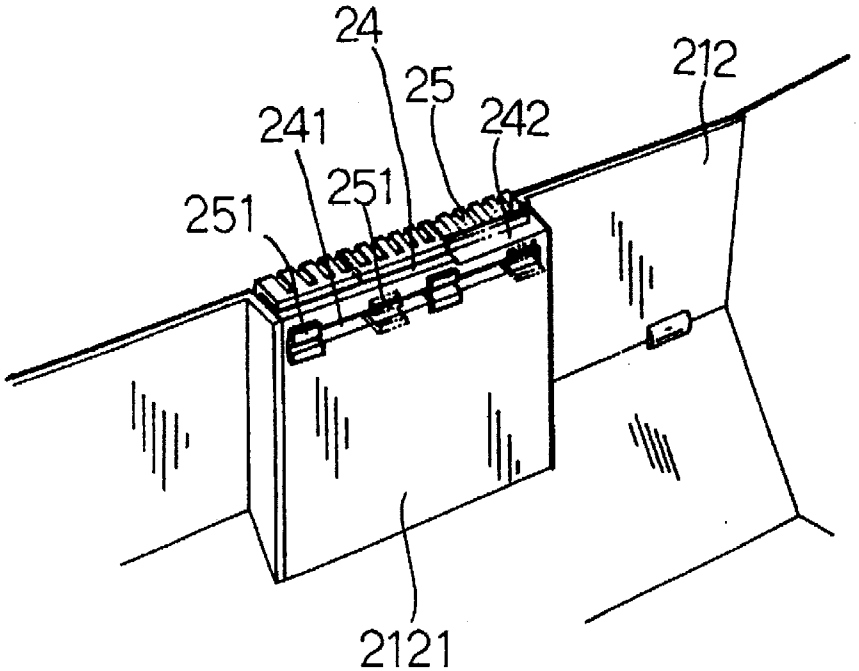
FIG. 4 is a schematic view illustrating the operation of a fastening switch of the main body of the preferred embodiment of the present invention.

A cover 3 is provided respectively at both ends of one side thereof with a male hinge 31 capable of cooperating with the female hinge 2111 in conjunction with a pin 34, as shown in FIG. 3. The cover 3 is further provided in another side thereof with a depression 32 and a protuberance 33 so as to facilitate the cover 3 to engage the opening 23, as shown in FIG. 2.

Figure 1:
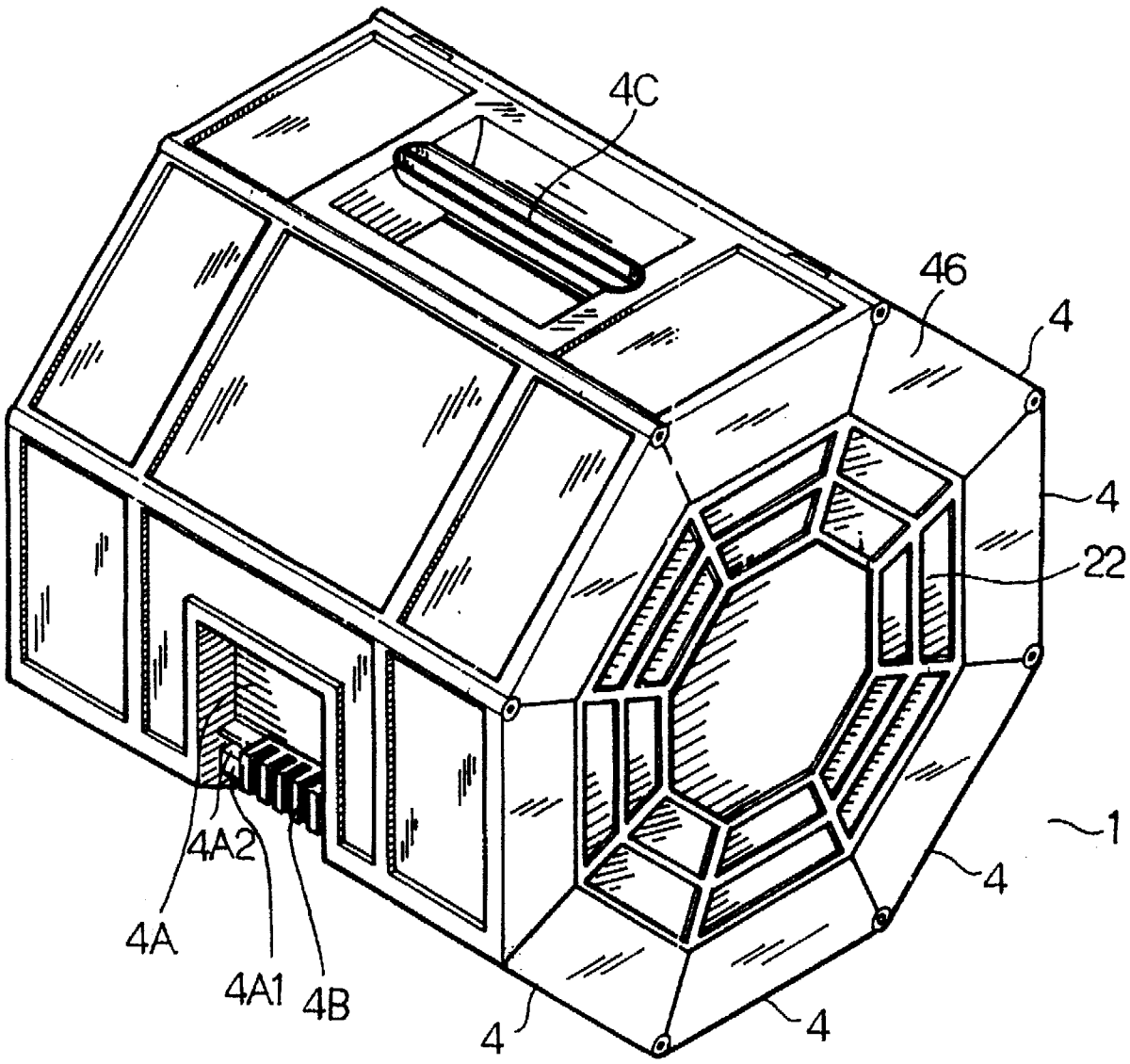
FIG. 1 shows a perspective view of the preferred embodiment of the present invention.

A plurality of receiving boxes 4 are fastened pivotally together by means of male hinges 41, female hinges 42 and pins 43. The first receiving box 4 is provided with hinges 47 engaging the female hinges 2122 and the pins 47A of the main body 2. The receiving boxes 4 are provided respectively with a plurality of slots 44 and partitions 45 and are further provided respectively at both longitudinal ends thereof with two trapezoidal plates 46. A first receiving box 4 is contiguous to the main body 2 and is provided at the midsegment of an outer side thereof with a recess 4A having a locating projection 4A1 with a slide hole 4A2 for locating a fastening block 4B. The locating projection 4A1 is provided at one end thereof with a depression 4A11, as shown in FIG. 1 and FIG. 2A. A third receiving box 4 is provided with a handle 4C fastened thereto. An outermost receiving box 4 is provided with a depression 4D having a protuberance 4D as shown in FIG. 2.

The receiving boxes 4 can be rolled in series to rest against the longitudinal sides 21 of the main body 2 such that the top edge of the trapezoidal plates 46 of each receiving box 4 is engaged with the recessed lip 221 of the end sides 22 of the main body 2, and that the protuberance 4D1 of the depression 4D of the outermost receiving box 4 is engaged with the fastening block 4B of the first receiving box 4.

The main body 2 is provided therein with a receiving space intended for keeping hand tools having a greater dimension while the receiving boxes 4 are provided respectively with a plurality of tool slots 44 for keeping hand tools having a relatively smaller dimension and for keeping component parts. The receiving boxes 4 can be disengaged with the main body 2 and spread out one by one by sliding the fastening block 25 of the main body 2 to its original position.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A combination-type tool box comprising:

a main body of a polygonal construction and having therein a receiving space for keeping hand tools, said main body further having a plurality of longitudinal sides and two end sides fastened with said longitudinal sides, with each of said end sides being provided in a periphery thereof with a recessed lip, with one of said longitudinal sides of said main body being provided with a locating projection and a fastening block capable of sliding on said locating projection; and a plurality of receiving boxes arranged in series and provided respectively with a plurality of tool slots and with two trapezoidal plates located at both longitudinal ends of each of said receiving boxes such that each of said trapezoidal plates is engageable with said recessed lip of said end sides of said main body, one of said receiving boxes being contiguous to said main body and fastened pivotally with said main body such that said receiving boxes can be rolled in series to rest against said longitudinal sides of said main body.

2. The combination-type tool box as defined in claim 1, wherein said recessed lip of said end sides of said main body is engaged with one of said trapezoidal plates of said receiving boxes when said receiving boxes are rolled in series to rest against said longitudinal sides of said main body.

3. The combination-type tool box as defined in claim 1, wherein said receiving box contiguous to said main body is provided with a male hinge for fastening said receiving box with said main body; and wherein one of said longitudinal sides of said main body is provided with a female hinge engageable with said male hinge of said receiving box.

4. The combination-type tool box as defined in claim 1, wherein one of said longitudinal sides of said main body is provided with an opening and a cover fastened pivotally with said opening.

5. The combination-type tool box as defined in claim 1, wherein said receiving boxes are provided with one or more male hinges or female hinges for fastening pivotally said receiving boxes in series.

6. The combination-type tool box as defined in claim 1, wherein one of said longitudinal sides of said main body is provided with a handle fastened therewith.

7. The combination-type tool box as defined in claim 1, wherein one of said receiving boxes is farthermost from said main body and is provided with a depression having a protuberance; and wherein one of said receiving boxes is contiguous to said main body and is provided with a fastening block engageable with said protuberance of said farthermost receiving box when said farthermost receiving box is rolled to rest against one of said longitudinal sides of said main body.

8. The combination-type tool box as defined in claim 7, whereto said protuberance of said farthermost receiving box can be disengaged with said fastening block of said receiving box contiguous to said main body so as to enable said receiving boxes to be spread out one after another.

* * * * *